US005816331A

United States Patent [19]

Vivier

[11] Patent Number: 5,816,331

[45] Date of Patent: Oct. 6, 1998

[54] FIRE EXTINGUISHER AND HARNESS FOR FIXING THIS EXTINGUISHER, WHEN PORTABLE, TO A SUPPORT

[75] Inventor: Daniel Vivier, Sussargues Castries, France

[73] Assignee: SNC S2E Services, Lyons, France

[21] Appl. No.: 757,569

[22] Filed: Nov. 27, 1996

[30] Foreign Application Priority Data

Dec. 5, 1995 [FR] France ..... 95 14518

[51] Int. Cl.[6] ..... A62C 13/00

[52] U.S. Cl. ..... 169/30; 169/51; 169/75

[58] Field of Search ..... 169/30, 51, 71, 169/74, 75, 88, 89; 239/526

[56] References Cited

FOREIGN PATENT DOCUMENTS 298 022 1/1989 European Pat. Off. .

92/06743 4/1992 WIPO .

*Primary Examiner*—Andrew C. Pike

*Attorney, Agent, or Firm*—Oliff & Berridge, PLC

[57] ABSTRACT

The extinguisher (1) includes a spray head (3) connected by a hose (4) to a tank (2) of fire-extinguishing product, and an activating mechanism (10, 11) is mounted on the tank. The spray head (3) includes a portion (25) which is shaped so as to engage with a part (11) of the activating mechanism (10, 11) when the spray head (3). is situated close to the tank (2); the activating mechanism (10, 11) then being in a position of nonactivation of the extinguisher (1). The shaped portion (25) of the spray head (3) separates from the engaged part (11) of the activating mechanism (10, 11) when the spray head (3) is separated from the tank (2), with this separation operating the activating mechanism (10, 11) so that the extinguisher (1) is activated.

10 Claims, 4 Drawing Sheets

FIRE EXTINGUISHER AND HARNESS FOR FIXING THIS EXTINGUISHER, WHEN PORTABLE, TO A SUPPORT

BACKGROUND OF THE INVENTION

The present invention relates to a fire extinguisher, and a harness for fixing this extinguisher, when portable, to a support such as a wall.

Such an extinguisher generally comprises a spray head connected by a hose to a tank containing the fire-extinguishing product.

The hose and the spray head are not kept permanently under pressure. It is therefore necessary in the event of a fire to activate the extinguisher by pressurizing the head and hose before spraying is begun.

The extinguisher may be of the "permanent pressure" type, in which the tank is kept permanently under pressure. Activating it then requires opening the valve to release the extinguishing agent under pressure into the hose.

The extinguisher may also be of the "auxiliary pressure" type, meaning that it is not kept permanently under pressure but comprises a cartridge of propellent gas which is struck at the moment of activation.

The activating mechanism generally comprises a sliding rod, coaxial with the tank, which either is connected to the moving part of the tank closure valve, in the case of a "permanent pressure" extinguisher, or has a sharp tip at its lower end with which to pierce the cap sealing the cartridge of propellant gas, in the case of an "auxiliary pressure" extinguisher.

The prior art includes operating this rod by means of a lever or button located on top of the tank and operated manually.

In both cases, in order to make use of the extinguisher, the user must withdraw the safety pin with which the activating mechanism is locked, operate the aforesaid lever or button in order to bring about activation, separate the spray head from the tank, and open the spray head by working a handle with which it is provided.

It is thus necessary to perform four operations one after the other in order to use the extinguisher, and these operations require the user to make movements which are far from instinctive. In a situation of panic, therefore, there may be a delay in using the extinguisher, or it may even be impossible to get it working. This may be of crucial importance in extinguishing the fire in its early stages, given that the sooner action is taken, the greater the chances are that the fire can be brought under control with the aid of a fire extinguisher.

In existing extinguishers, furthermore, there is nothing to prevent a careless user from replacing the activating handle or button and the safety pin in their original positions after using it, having partly or completely emptied the tank. The absence of the tamper-evident seal from the extinguisher is not easy to spot, so portable extinguishers can be put back in position on their supporting harnesses without it being immediately noticeable that they have already been used.

Another point is that existing portable fire extinguishers can be quite difficult for short or weak persons to remove from their supports because of the weight of the equipment.

In addition, existing fire extinguishers and their supporting harnesses are not visually attractive.

SUMMARY OF THE INVENTION

It is an object of the present invention to overcome all of these drawbacks by providing a fire extinguisher and a harness for fixing this extinguisher, when portable, to a support. The present invention enables the extinguisher to be put to use easily, quickly, and above all instinctively. The present invention also allows any use of the fire extinguisher to be immediately visible, as well as making removal of the fire extinguisher simple and easy, while enabling a visually attractive overall appearance.

This fire extinguisher comprises, in a known way, a spray head connected by a hose to the tank of fire-extinguishing product, an extinguisher activating mechanism, that is to say a mechanism for pressurizing the head and hose when the extinguisher is being used, and means for the user to operate this mechanism.

According to the invention, the spray head includes a portion which is shaped so as to engage with a part of the activating mechanism when the spray head is situated close to the tank. When the spray head is situated close to the tank the mechanism is in a position of nonactivation of the extinguisher. The shaped portion of the head separating from this part of the activating mechanism when the head is separated from the tank, with the separation operating the mechanism so that the extinguisher is activated.

Thus, after the safety pin has been withdrawn, the fire extinguisher is activated by simply separating the spray head from the tank. As a result, only three operations are required to make use of the extinguisher, namely withdrawing the pin, separating the spray head from the tank, and opening the spray head.

These operations are simple, quick, and instinctive, as the first action that will come to the mind of a user is to grasp the spray head and separate it from the tank of the fire extinguisher.

The spray head is mounted on top of the tank rather than on its side. It is thus immediately visible to the user as he removes the extinguisher from its mounting, and to grasp it is also an instinctive action.

Before being withdrawn, the safety pin keeps the spray head locked onto the top of the tank. Thus, if the user tries to separate the spray head from the tank, but fails, he will immediately realize that this is because the safety pin has not been pulled out. The invention therefore also eliminates any risk of error in performing the different stages required to use the extinguisher.

The spray head is advantageously in the general shape of a gun with a trigger. The trigger comprises said portion that engages with said part of the activating mechanism of the extinguisher.

The spray head is ergonomically shaped, and both grasping it and opening it by pressing the trigger require the user to make actions that are simple, easy to perform, and instinctive.

The axis of movement of the safety pin is advantageously inclined with respect to the horizontal and the end by which the pin may be grasped is turned upward. The angle of the axis of movement with respect to the horizontal is advantageously 45°.

The fire extinguisher preferably comprises means which, after the extinguisher has been activated, prevent said portion of the spray head from being re-engaged with said corresponding part of the activating mechanism, thus preventing this head from being put back in position on top of the tank. This impossibility of putting the spray head back in position renders the activation of the extinguisher immediately visible because the head can now only hang down the side of the tank.

In a preferred embodiment of this fire extinguisher, the activating mechanism comprises a rod that can slide between a position of nonactivation and a position of activation of the extinguisher, and a lever mounted so as to pivot about an axis perpendicular to the rod. The lever includes a portion in the form of a cam that can push on the rod and a portion that is engaged through an opening formed in the trigger of the spray head. The portion of the lever engaged through said opening in the trigger, and said opening are shaped so that withdrawal of the spray head causes the lever to pivot and therefore moves the rod into the position of activation of the extinguisher.

In another embodiment of this fire extinguisher, the activating mechanism of the extinguisher comprises a rod that can slide between a position of nonactivation and a position of activation of the extinguisher, a slider that can act on this rod so as to move it into the position of activation of the extinguisher, and biasing means acting on this slider in order to move it and so operate the rod, the assembly being shaped so that the trigger keeps the slider in a position of nonactivation of the rod, in opposition to the biasing means.

Withdrawing the trigger thus releases the slider, which, under the action of the biasing means with which it is provided, can move and so operate the rod in the appropriate direction for activating the extinguisher.

The harness for supporting a portable fire extinguisher according to the invention is advantageously shaped in such a way that it is impossible to rehang the extinguisher in it when the head is not in its position of assembly on top of the tank, with engagement of its abovementioned portion and of the corresponding part of the operating mechanism.

There is thus no risk that a careless user could replace a partly or completely emptied fire extinguisher in its harness.

In a preferred embodiment of the invention, the harness is integral with a jacket whose free edge is shaped so as generally to fit the outline of the extinguisher and has an upper portion shaped so that it will not accommodate the spray head unless this head is installed in its position of assembly on the extinguisher. Besides the fact that the extinguisher cannot be rehung in the harness when the head is separated from the tank, this jacket provides the advantage of covering that part of the tank along which the hose lies, and thus gives the fire extinguisher and harness together an attractive visual appearance.

The harness is preferably shaped in such a way that the extinguisher is tilted toward the user. This inclination helps when removing the extinguisher from its mounting.

The extinguisher possesses a carrying handle at the top, advantageously arranged at right angles to the spray head.

This handle also facilitates the removal of the extinguisher from its mounting and contributes to the ergonomics of the equipment.

The harness is advantageously also equipped with a locally weakened flexible strap passing around the extinguisher, this strap being designed to be broken when the extinguisher is withdrawn from the harness.

The breaking of this strap serves as an immediate visual sign that the extinguisher has been taken out of its harness.

BRIEF DESCRIPTION OF THE DRAWINGS

In order that the invention may be understood properly, it is described below with reference to the attached drawings showing, by way of examples, two embodiments of the portable fire extinguisher to which it relates.

DESCRIPTION OF THE PREFERRED EMBODIMENTS

Figure 1:
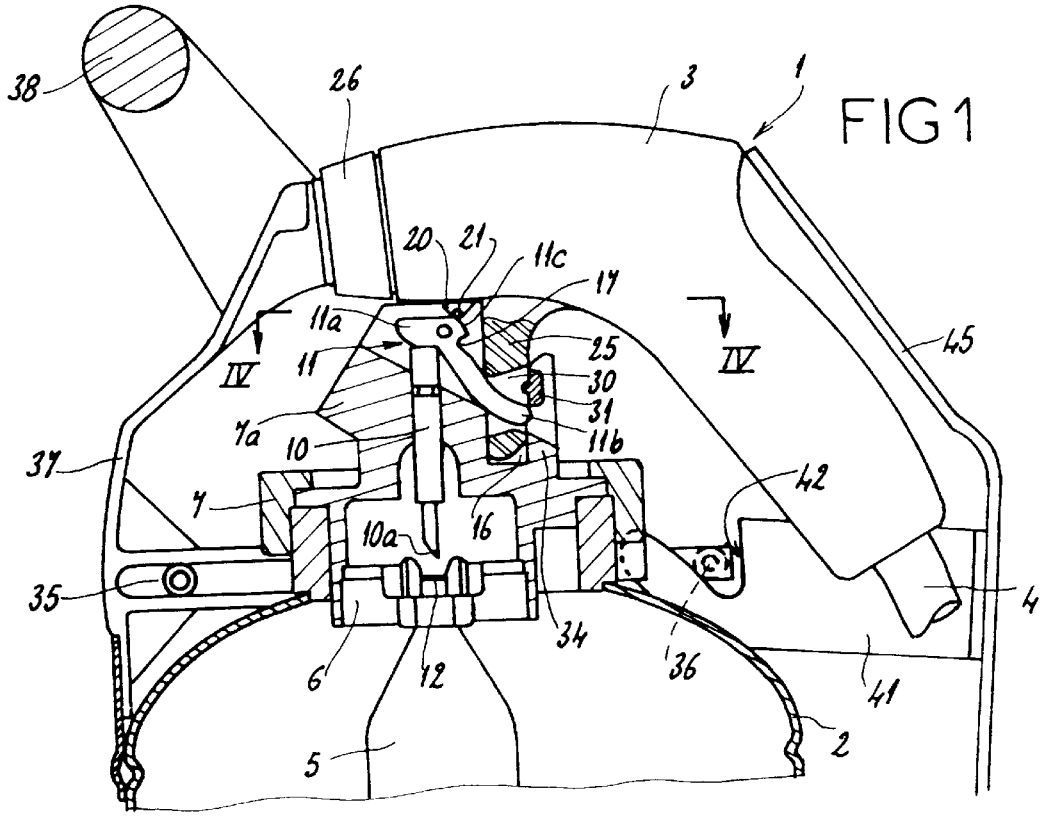
FIG. 1 is a side elevation view in partial cross section of the upper part of a fire extinguisher in one embodiment, showing the spray head and the upper part of the harness enabling the extinguisher to be fixed to a support, such as a wall.

FIGS. 1 to 4 show the upper part of a fire extinguisher 1 comprising a tank 2 of fire-extinguishing product, a spray head 3 for spraying this product, and a hose 4 connecting the tank 2 to the head 3.

The fire extinguisher 1 shown in these figures is of the "auxiliary pressure" type in which the tank 2 is pressurized at the time of use by striking a cartridge 5 containing a propellant gas.

The cartridge 5 is held by radial arms 6, integral with the part 7 which seals the tank 2, that define apertures between themselves allowing communication between the top end of the cartridge 5 and the interior of the tank 2.

The cartridge 5 is struck by means of an activating mechanism comprising a rod 10 and a lever 11.

The rod 10 has a sharp tip 10*a* at its lower end and can slide vertically between a position of nonactivation (FIG. 1) and a position of activation (FIG. 3) of the fire extinguisher 1. In this second position, the tip 10*a* pierces the cap 12 that seals the cartridge 5.

The lever 11 is housed in an enclosure formed in the upper portion 7*a* of the part 7, and is mounted so as to pivot about an axis perpendicular to the rod 10. It includes a portion 11*a* in the form of a cam that rests on the upper end of the rod 10, and a portion 11*b* that fits into a housing 16 whose upper end is open.

The lever 11 also includes a rounded bearing surface 11*c* and a notch 17 next to this bearing surface 11*c*. The notch 17 is shaped so as to define a catch at the end of the portion 11*c*.

The upper portion 7*a* of the part 7 comprises a recess 20 on its upper surface and two coaxial bores leading, on one side, into this recess 20 and, on the other side, into the side faces of the portion 7*a*.

These bores accommodate a spring wire 21, with friction.

The distance between the wire 21 and the pivot pin of the lever 11 is less than the distance between the bearing surface 11*c* and this pin. The design is such that the bearing surface 11*c* deforms the wire 21 as the lever 11 pivots and drives the rod 10 down (FIG. 2), and such that the wire 21 enters the notch 17 and locks itself in position by elastic reaction when the lever 11 has reached the end of its pivoting movement (FIG. 3). In this final activated position, wire 21 is engaged behind the catch which the notch 17 defines at the end of the bearing surface 11*c*.

The spray head 3 is in the general shape of a gun and has a trigger 25.

This trigger 25 is connected to a mechanism (not shown because known per se) for opening or closing the spray nozzle 26 in the head 3 in order to initiate or stop the spray.

Figure 2:
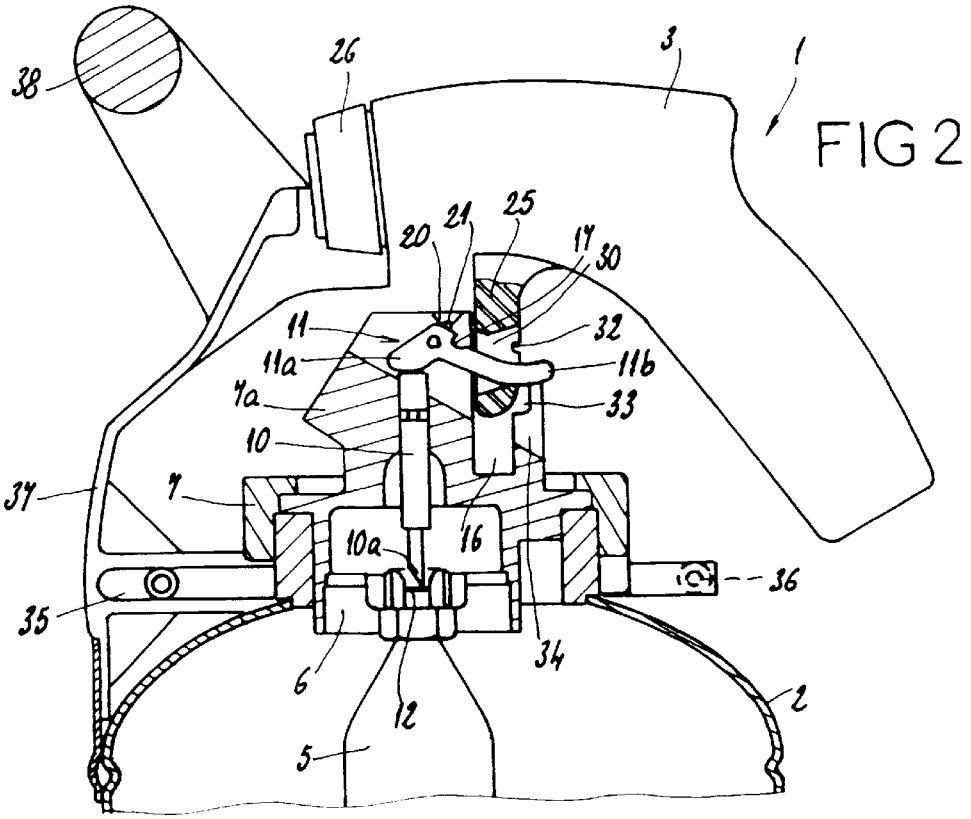
FIGS. 2 and 3 are side elevation views similar to FIG. 1, showing the extinguisher during and at the end of activation, respectively.
Figure 3:
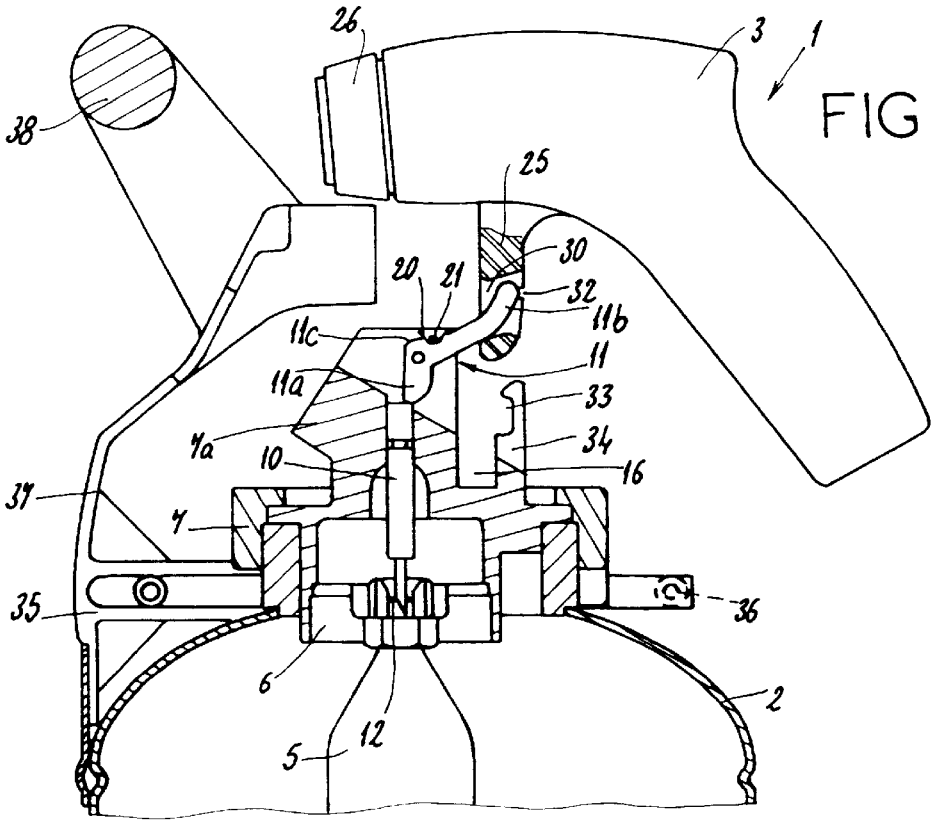

As shown in FIGS. 1–3, the trigger 25 is designed to fit in the housing 16, and comprises an aperture 30 whose shape enables it to take the portion 11*b* of the lever 11 and to pivot this lever 11 in the direction of activation of the extinguisher 1 when the trigger 25 is extracted from this housing 16, i.e., when the head 3 is separated from the tank 2.

In addition, the extinguisher 1 possesses a safety pin 31 for ensuring that the trigger 25 stays in the housing 16. This pin 31 has a pull ring 31*a* and a straight portion 31*b* engaged in notches 32, 33 formed respectively in the trigger 25 and in the wall 34 of the part 7 that defines the housing 16.

The fire extinguisher 1 also has a flange 35 integral with the part 7 and provided with two lugs 36 for hanging the extinguisher 1 in its supporting harness, and an upper hood piece 37 with a carrying handle 38, the latter being set at right angles to the spray head 3.

Figure 6:
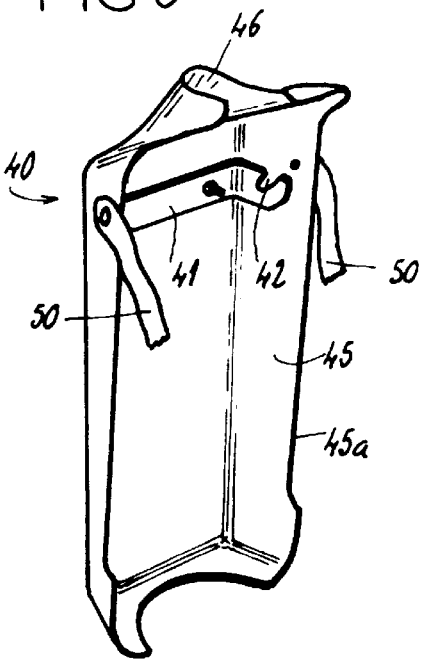
FIG. 6 is a perspective view of the supporting harness after the removal of the fire extinguisher.

As shown in FIG. 6, the harness 40 includes a hanging bracket 41, whose lateral arms contain flared notches 42 for the lugs 36.

The bracket 41 is shaped in such a way that the extinguisher 1, when installed in the harness 40, is tilted toward the user.

This bracket 41 is also integral with a jacket 45 which has a free edge 45*a* shaped so as generally to fit the outline of the extinguisher 1. The jacket 45 also includes an upper recess 46 which fits around the head 3 when this head is installed on the part 7 in order that the fire extinguisher 1 cannot be rehung on the bracket 41 unless the head 3 is in its position of assembly on the portion 7.

The jacket 45 is equipped with a locally weakened flexible strap 50 passing around the extinguisher 1, this strap being designed to be broken when the extinguisher 1 is withdrawn from the harness 40.

In practice, the extinguisher 1 can be withdrawn from the harness 40 with ease, thanks to its being tilted toward the user, and also to the flared form of the notches 42 and the shaping of the handle 38. This withdrawal causes the strap 50 to break.

Once the pin 31 has been pulled out, the act of separating the head 3 from the part 7 is sufficient to pivot the lever 11, drive down the rod 10, and pierce the cap 12, activating the fire extinguisher 1 in the process.

To activate the fire extinguisher therefore requires only three operations (pulling out the pin 31, separating the spray head 3 from the tank 2, and opening the head 3 by squeezing the trigger 25). These operations are simple, quick, and instinctive, since the first action that comes to the mind of a user is to grasp the head 3 in order to separate it from the tank 2.

If the user is unable to separate it, he will at once realize that this is due to the fact that the pin 31 has not been pulled out. Any risk of error in putting the fire extinguisher 1 to use is thus eliminated.

The wire 21, the bearing surface 11*c*, and the notch 17 are means of maintaining the lever 11 in its position corresponding to activation of the fire extinguisher 1, illustrated in FIG. 3. In this position, the lever 11, in combination with the wall 34, prevents the trigger 25 from being reinserted into the housing 16, and therefore prevents the head 3 from being replaced on the part 7.

The fact that the fire extinguisher 1 has been activated is thus immediately visible, and the appliance cannot be rehung on the bracket 41, since the head 3 cannot be engaged in the notch 46 and is an obstacle to the re-engagement of the lugs 36 in the notches 42.

Figure 7:
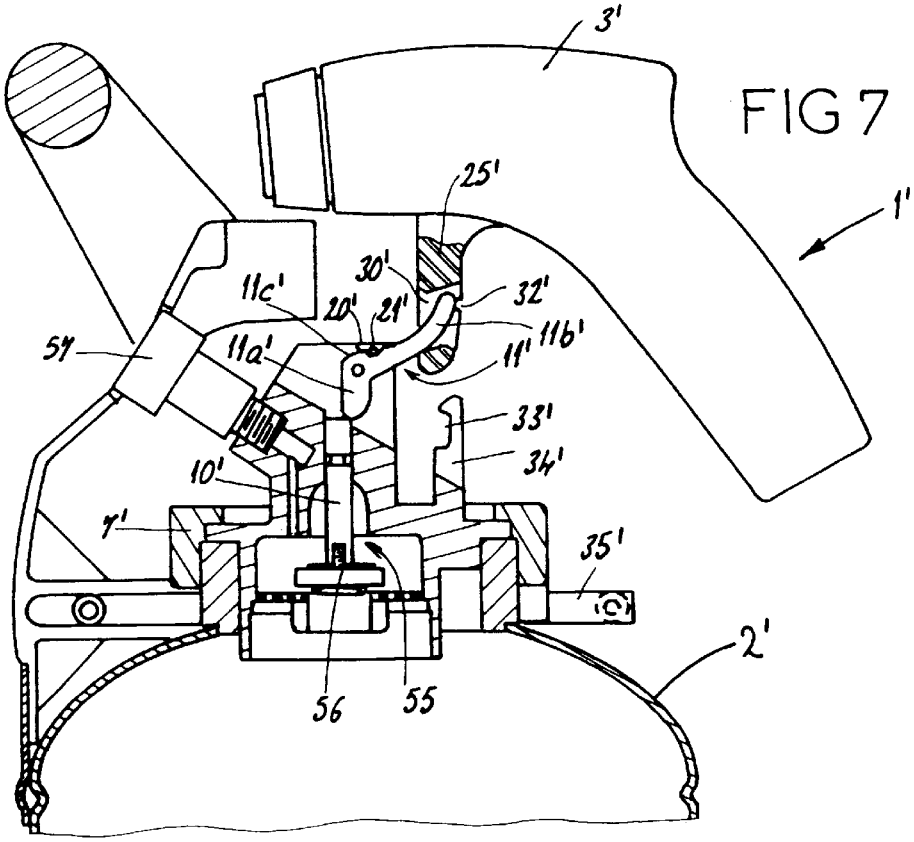
FIG. 7 is a view similar to FIG. 3 showing another type of fire extinguisher at the end of activation.
Figure 4:
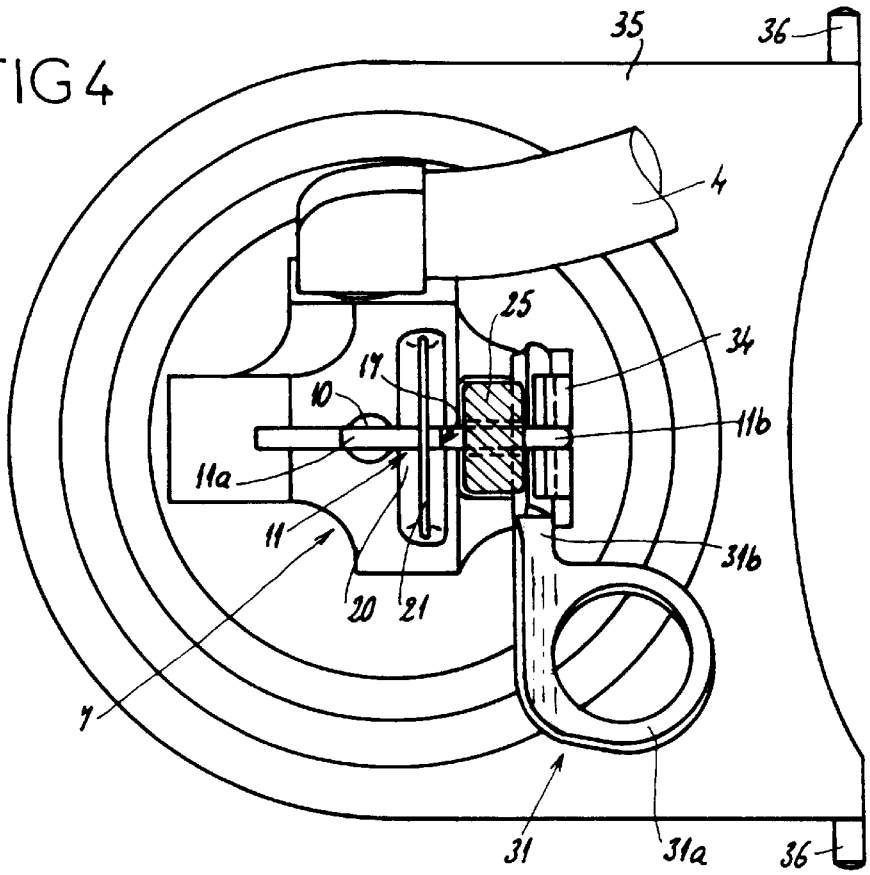
FIG. 4 is a top view of the upper part of the extinguisher taken along section IV—IV as indicated in FIG. 1.
Figure 5:
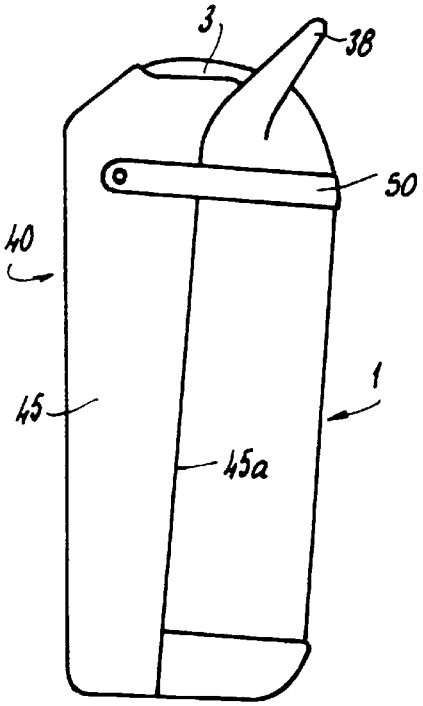
FIG. 5 is a side elevation view of the fire extinguisher as installed in its supporting harness.

FIG. 7 shows a fire extinguisher of the "permanent pressure" type, in which the tank is kept permanently under pressure. Activation here involves opening the valve 55 that separates the tank from the hose.

For simplicity's sake, parts already described with reference to FIGS. 1 to 6 and also present in this fire extinguisher are given related reference numerals 1, 2, 3, 7, 10, 11, 11*a*, 11*b*, 11*c*, 20, 21, 25, 30, 32, 33, 34, and 35 in the embodiment shown in of FIGS. 1–6 are replaced with parts 1', 2', 3', 7', 10', 11', 11*a*', 11*b*', 11*c*', 20', 21', 25', 30', 32', 33', 34', and 35' of FIG. 7.

In this version, the moving part 56 of the valve 55 is mounted on the lower end of the rod 10', so that when this rod 10' is driven down, the valve 55 opens.

This extinguisher 1' may also possess a pressure gauge 57 to enable the pressure inside the tank 2' to be checked.

Figure 8:
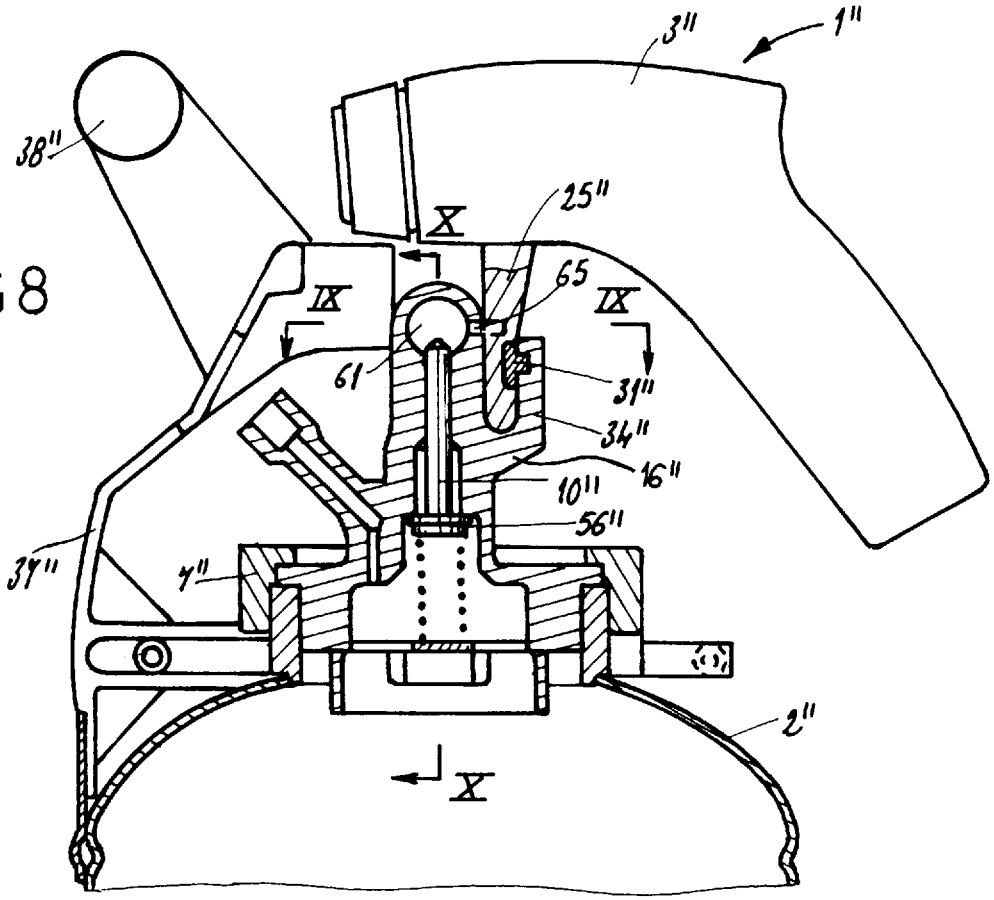
FIG. 8 is a side view in partial cross section of the upper part of a fire extinguisher in a second embodiment.
Figure 9:
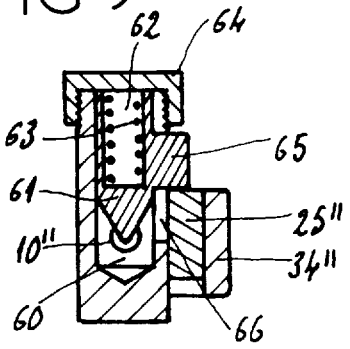
FIG. 9 is a partial view of the same, in cross section on IX—IX as indicated in FIG. 8.
Figure 10:
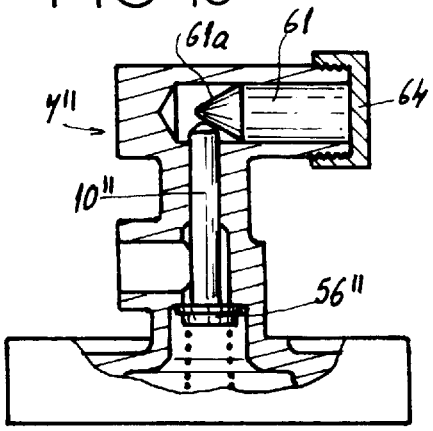
FIG. 10 is a partial view of the same, in cross section on X—X as indicated in FIG. 8.

FIGS. 8 to 10 show another "permanent pressure" extinguisher, and parts already described are given related reference numerals i.e., parts 1, 2, 3, 7, 10, 16, 25, 31, 34, 37, and 38 in the embodiment shown in FIGS. 1–6 are replaced with parts 1", 2", 3", 7", 10", 16", 25", 31", 34", 37", and 38" of FIGS. 8–10, and part 56 in the embodiment shown in FIG. 7 is replaced with part 56" in FIGS. 8 and 10.

In this version, the part 7" contains a bore 60 at its upper end into which the rod 10" projects. The lever 11 is replaced by a slider 61 engaged in this bore 60.

This slider 61 comprises:

- a blind hole 62 containing a spring 63 pressing against the blind end of the hole 62 and against a cap 64 that closes off the bore 60,
- a pointed tip 61*a* forming a slope to bear on the rod 10", and
- a radial lug 65 engaged in a slot 66 through which it projects and rests against the trigger 25", when the latter is engaged in the housing 16".

This resting against the trigger keeps the slider 61 in a position of nonactivation of the rod 10", in opposition to the spring 63, which is compressed. When the trigger 25" is withdrawn from its housing 16", the spring 63 acts on the slider 61 and moves it in such a way as to operate the rod 10". The strength of this spring 63 is calibrated to make it impossible for the user to replace the trigger 25" in the housing 16".

The invention is obviously not restricted to the embodiment described above by way of example but, on the contrary, encompasses all alternative embodiments thereof. For example, the fire extinguisher to which it relates may be portable, as shown in the drawing, or be mounted on a carriage or be fixed.

It is claimed:

1. A fire extinguisher comprising:

a tank of fire-extinguishing product;

a hose;

a spray head, said spray head being connected by said hose to said tank; and an activating mechanism mounted on said tank for controllably releasing said fire-extinguishing product from said tank through said hose to said spray head;

a portion of said spray head defining a recess, and a part of said activating mechanism engaging in said recess when said spray head is in a mounted position on said tank;

said part of said activating mechanism disengaging from said recess and releasing said fire-extinguishing product from said tank when said spray head is removed from said mounted position on said tank.

2. The fire extinguisher according to claim 1, wherein said spray head is shaped approximately like a gun with said portion of said spray head being a trigger of said gun.

3. The fire extinguisher according to claim 2, wherein said activating mechanism comprises a rod slidably mounted within said activating mechanism for movement between a position of nonactivation wherein said fire-extinguishing product is contained within said tank and a position of activation wherein said fire-extinguishing product is released from said tank, said part of said activating mechanism comprising a lever, with said lever being pivotally mounted relative to said rod and having a cam at one end of said lever such that removal of said spray head from said mounted position on said tank causes said lever to pivot and said cam activates said rod from said position of nonactivation to said position of activation.

4. The fire extinguisher according to claim 2, wherein said activating mechanism comprises a rod slidably mounted within said activating mechanism for movement between a position of nonactivation wherein said fire-extinguishing product is contained within said tank and a position of activation wherein said fire-extinguishing product is released from said tank, a slider also being slidably mounted within said activating mechanism relative to said rod, and biasing means for urging said slider from a first position wherein said slider contacts said rod in said position of nonactivation to a second position wherein said slider contacts said rod in said position of activation, said trigger contacting said slider and holding said slider in said first position against said biasing means when said spray head is in said mounted position on said tank.

5. The fire extinguisher according to claim 1, further including a removable safety pin having an axis and a gripping end, said safety pin extending through said activating mechanism when said spray head is in said mounted position on said tank with said safety pin preventing said disengaging of said part of said activating mechanism from said recess until said safety pin is removed from said activating mechanism.

6. The fire extinguisher according to claim 1, further including means for preventing said spray head from being returned to said mounted position on said tank after said disengaging of said part from said recess.

7. The fire extinguisher according to claim 1, further including a harness, said harness being shaped to mount said tank, said hose, and said spray head only when said spray head is in said mounted position on said tank.

8. The fire extinguisher according to claim 7, further including a jacket having an inner periphery shaped to fit over an outer periphery of said tank and said spray head when said spray head is in said mounted position on said tank.

9. The fire extinguisher according to claim 7, wherein said harness mounts said tank, said hose, and said spray head tilted toward a user when said spray head is in said mounted position on said tank.

10. The fire extinguisher according to claim 7, wherein said harness includes a flexible strap having a local weakness passing around said tank when said spray head is in said mounted position on said tank, said flexible strap breaking at said local weakness when said tank is removed from said harness.

* * * * *